US010086991B2

(12) United States Patent
Savage

(10) Patent No.: US 10,086,991 B2
(45) **Date of Patent: *Oct. 2, 2018**

(54) CARTRIDGE

(71) Applicant: Christopher M. Savage, Woodbridge, VA (US)

(72) Inventor: Christopher M. Savage, Woodbridge, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/917,790

(22) Filed: Mar. 11, 2018

(65) Prior Publication Data

US 2018/0194546 A1 Jul. 12, 2018

Related U.S. Application Data

(63) Continuation of application No. 14/692,606, filed on Apr. 21, 2015, now Pat. No. 9,944,455.

(60) Provisional application No. 61/987,760, filed on May 2, 2014.

(51) Int. Cl.
*B65D 85/804* (2006.01)
*B65D 65/46* (2006.01)

(52) U.S. Cl.
CPC ..... *B65D 85/8043* (2013.01); *B65D 65/466* (2013.01); *B65D 85/8046* (2013.01)

(58) Field of Classification Search
CPC ..... B65D 85/8043; B65D 85/8046; B65D 65/466
See application file for complete search history.

(56) References Cited

U.S. PATENT DOCUMENTS

2011/0097450 A1 4/2011 Kruger
2013/0059039 A1 3/2013 Trombetta
2013/0078342 A1 3/2013 Loebl

*Primary Examiner* — Viren A Thakur
*Assistant Examiner* — Chaim A Smith
(74) *Attorney, Agent, or Firm* — David Grossman

(57) ABSTRACT

A cartridge may comprise a container, a filter, a lid, and a substance. The container may comprise a pierceable bottom portion structurally configured to be pierceable by a first machine piercing element. The filter may be disposed inside the container. The filter may comprise a pre-shaped concave center portion, attachment portions and an opening. The pre-shaped concave center portion may be disposed above the pierceable bottom portion. The attachment portion(s) may be along a periphery of the pre-shaped concave center portion and fastened to the container bottom. The filter opening may contact a sidewall of the container. The lid may be attached to an opening of the container and may comprise a pierceable lid portion structurally configured to be pierceable by a second machine piercing element. The substance may be disposed in an interior space of the filter.

20 Claims, 9 Drawing Sheets

CARTRIDGE

CROSS-REFERENCE TO RELATED APPLICATIONS

This application is a continuation of U.S. application Ser. No. 14/692,606, filed Apr. 21, 2015, which claims the benefit of U.S. Provisional Application No. 61/987,760, filed May 2, 2014, which are hereby incorporated by reference in their entirety.

BRIEF DESCRIPTION OF THE DRAWINGS

The accompanying drawings, which are incorporated in and constitute a part of this specification, illustrate some implementations described herein and, together with the description, explain these implementations. In the drawings.

Example

Example

Example

Example

Example

Example

Example

Example

DETAILED DESCRIPTION OF EMBODIMENTS

The following detailed description refers to the accompanying drawings. The same reference numbers in different drawings may identify the same or similar elements. The illustrative embodiments described herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Embodiments of the present invention relate generally to the provision of a novel solution mixing cartridge. One of the various uses of a solution mixing cartridge is as a single serve beverage cartridge configured to produce beverages such as tea, coffee and/or the like. However, one skilled in the art will recognize that this novel cartridge configuration may be employed in other areas wherein a cartridge may be employed to create a solution by mixing a substance and a solute, for example, a cartridge for mixing glue, paint, and/or the like.

A solution may be a mixture that includes a solute substance dissolved (or partially dissolved) in a solvent substance. The solvent may do the dissolving. The solution may, more or less, take on the characteristics of the solvent including its phase, and the solvent may be the major fraction of the mixture. The concentration of a solute in a solution may be a measure of how much of that solute is dissolved in the solvent.

A solute may be a chemically different liquid, solid or gas than a solvent. A solvent is usually a liquid but can also be a solid or a gas. The maximum quantity of solute that can dissolve in a specific volume of solvent varies with temperature. Common uses for organic solvents are in dry cleaning (e.g., tetrachloroethylene), as paint thinners (e.g., toluene, turpentine), as nail polish removers and glue solvents (acetone, methyl acetate, ethyl acetate), in spot removers (e.g., hexane, petrol ether), in detergents (citrus terpenes), in perfumes (ethanol), nail polish and in chemical synthesis. The use of inorganic solvents (other than water) may be employed in research chemistry and some technological processes.

An example of one of various solutions that may be produced using solution mixing cartridge embodiments may be a beverage. A beverage may include a drink or other liquid prepared for human consumption. Examples of beverages include, but are not limited to: juice, soft drinks, carbonated drinks, coffee, teas, combinations thereof, and/or the like. Tea is an aromatic beverage commonly prepared by pouring hot or boiling water over leaves of the tea plant at which time the hot water may act as a solvent to dissolve parts of the tea leaves (acting as a solute) to form a tea solution. Some beverages may include alcohol.

Figure 1:
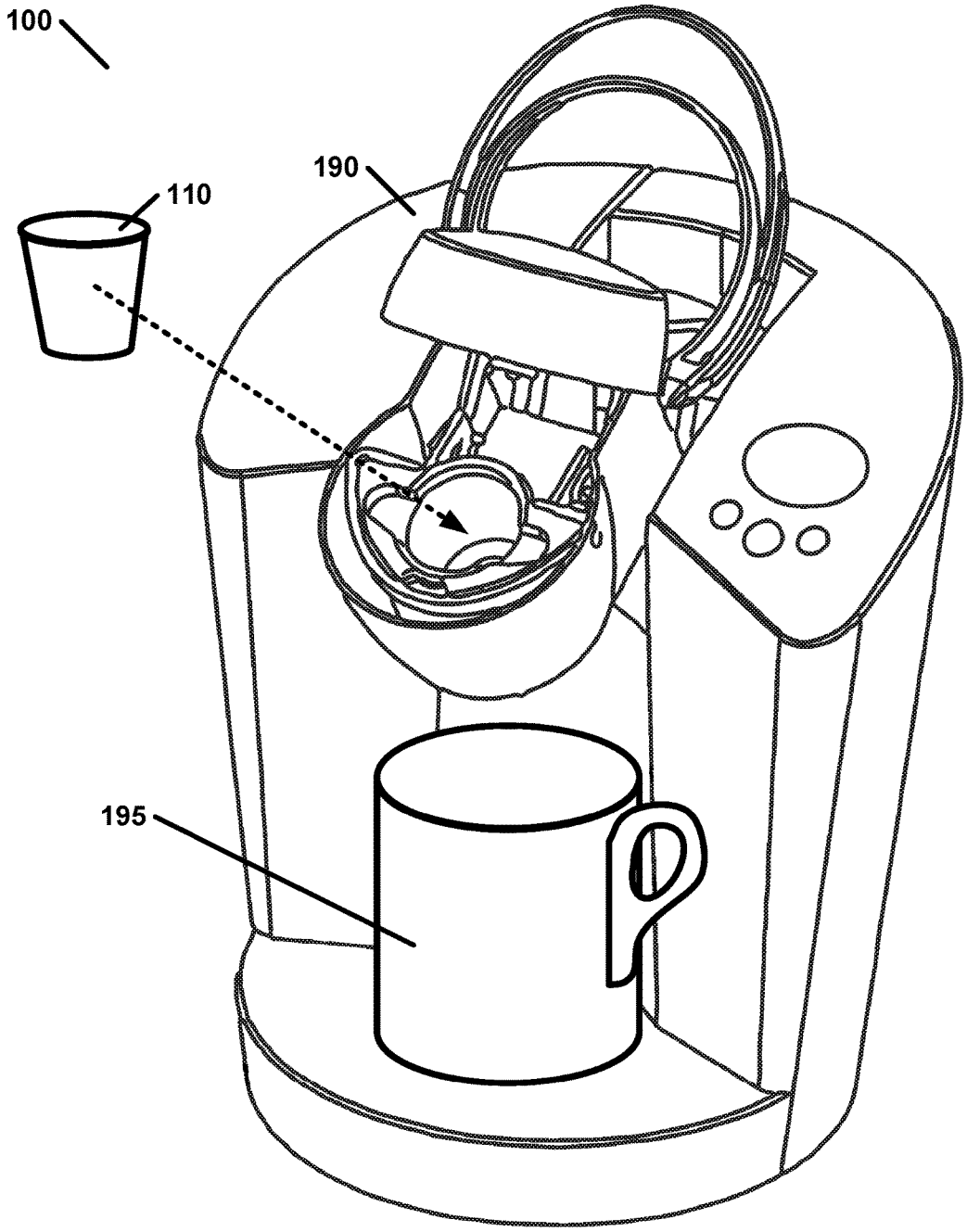
FIG. 1 is a diagram illustrating a brewing machine and cartridge as per an aspect of an embodiment of the present invention.

FIG. 1 which is a diagram illustrating a system 100 that may employ a beverage machine 190 and cartridge 110 to produce a beverage solution. The beverage cartridge 110 may be used in a beverage machine 190 to form a suitable beverage such as tea, coffee, other infusion-type beverages, beverages formed from a liquid or powdered concentrate, etc. In this illustrative embodiment, the cartridge 110 may be configured for use with a beverage machine 190 to form a beverage such as coffee, tea, and/or the like. However, as discussed earlier, aspects of the cartridge 110 are not limited in this respect.

According to some of the various embodiments, cartridge 110 may be placed in brewing machine 190 and operated to generate, for example, a hot beverage. Cartridge 110 may comprise, a container, a filter, a brewing medium and a lid. The brewing medium may include a brewing material such as coffee, tea, hot chocolate, and/or the like. The brewing machine 190 may puncture the lid and the bottom of the cartridge and force hot water under pressure through the cartridge and into a mug 195.

Figure 2:
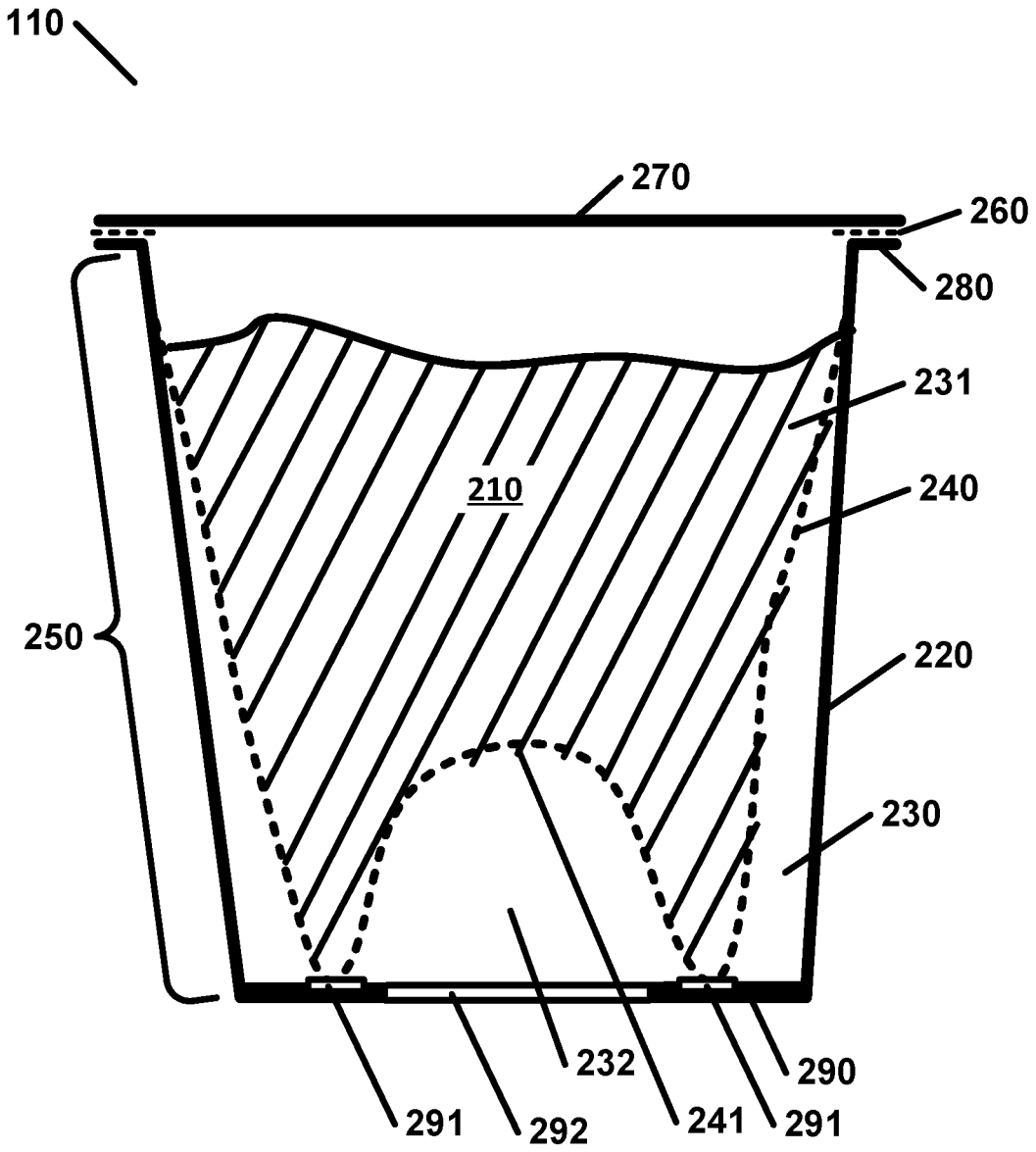
FIG. 2 is a diagram of a side cross-sectional view of a cartridge as per an aspect of an embodiment of the present invention.

FIG. 2 illustrates a side cross-sectional view of an example solution mixing cartridge 110 as per an aspect of an embodiment of the present invention. Cartridge 110 may contain a solute 210. Solute 210 may be beverage medium, e.g., ground coffee, tea leaves, dry herbal tea, powdered beverage concentrate, dried fruit extract or powder, powdered or liquid concentrated bouillon or other soup, powdered or liquid medicinal materials (such as powdered vitamins, drugs or other pharmaceuticals, nutriceuticals, etc.), and/or other beverage-making material (such as powdered milk or other creamers, creamed honey, honey sweeteners, thickeners, flavorings, and so on). Throughout this disclosure, the term beverage medium, medium, and/or the like is used as a specific example of a solute. One skilled in the art will recognize that other solutes could be substituted to generate various and/or alternative embodiments.

In this illustrative embodiment, cartridge 110 includes a container 220 that further includes an interior space 230 having a first chamber 231 and a second chamber 232 separated by a filter 240. However, other additional chambers in the interior space and/or sub-portions or areas of the first chamber 231 and second chamber 232, may be provided in other embodiments. For example, the first chamber 231 and/or second chamber 232 may be divided or otherwise separated into two or more portions or areas by filters, walls, dividers, passageways, other features, and/or the like.

In this example embodiment, container 220 may have a shaped cup with a sidewall 250 and an opening 260. According to various embodiments, the container 220 may have many shapes, such as for example, a fluted, conical, or cylindrical shape, a square or rectangular cup shape, a domed cup shape, a sphere or partial sphere shape, or other suitable form. Container 220 may have a fluted, corrugated, or otherwise shaped sidewall. Also, container 220 need not necessarily have a defined shape, as is the case with some beverage sachets and pods. For example, although container 220 in the illustrated embodiment has a relatively rigid and/or resilient construction so that the container 220 may tend to maintain its shape, the container 220 could be made to have a more compliant and/or deformable arrangement, e.g., like a sachet container made from a sheet of deformable material. Thus, an interior space 230 defined by the container 220 may be formed after the container material is formed around a beverage medium 210, filter 240 and/or other cartridge components.

If the container 220 includes an opening 260, the opening 260 may be closed by a lid 270. According to some of the various embodiments, lid 270 may be, for example, a foil and polymer laminate material that is attached to a rim 280 of the container 220. Although in this embodiment the rim 280 is arranged as an annular flange-like element, the rim 280 may be arranged in other ways. For example, the rim 280 may be the top edge of the sidewall 250 without a flange element. The container 220 and/or the lid 270 may provide a barrier to moisture and/or gases, such as oxygen. For example, the container 220 may be made of a polymer laminate, e.g., formed from a sheet including a layer of polystyrene or polypropylene and a layer of ethylene vinyl alcohol and/or other barrier material, such as a metallic foil. Such an arrangement may provide suitable protection for the beverage medium 210, e.g., from unwanted exposure to moisture, oxygen and/or other materials. Furthermore, container 220 and/or lid 270 may be made of other materials or combinations of materials, such as biopolymers, compostable polymers, paper, foils, etc.

In accordance with an aspect of the invention, the filter 240 may be attached to the bottom of the container 290 on at least one or more portions, as indicated as a point of attachment 291. The filter 240 may have a concave middle area. 241 positioned above a pierceable portion of the bottom 292. The filter 240 may be arranged between the first chamber 231 and second chamber 232 of the interior space 230 so that liquid in the first chamber 231 of the interior space (e.g., that interacts with beverage medium 210) flows through the filter 240 and toward the second chamber 232 of the interior space 230 before exiting the container 220. The filter 240 may function to remove materials over a certain size from a liquid, e.g., may remove coffee grounds from liquid in the first chamber 231, allowing a coffee beverage to pass through the filter 240 to the second chamber 232. For example, the filter 240 may include a piece of filter paper that is arranged to allow a liquid and dissolved and/or suspended materials of a certain size to pass, yet prevent relatively large particles from flowing through the filter 240. According to some of the various embodiments, the filter 240 may have multiple stages, e.g., a coarse filter portion that filters out relatively large particles, followed by a fine filter portion that filters relatively smaller particles, and so on. In addition, filter 240 may include one or more portions that function to filter liquid passing through filter 240, as well as portions that may be impermeable or otherwise restrict flow. Thus, filter 40 may include two or more separate components, if desired. Furthermore, not all portions of the filter may need to be permeable to liquids. The filter 240 may also have areas with different permeability, e.g., to help direct flow toward one or more areas of the filter 240. For example, regions of the filter 240 near the lid 270 may have a relatively lower permeability as compared to regions further away from the lid 270. This may help errs or rage flow through the beverage medium 210 toward lower regions of the filter 240, potentially improving the dissolution of materials in the medium 210 into the liquid.

The filter 240 may also, or alternately, function to help prevent the movement of materials from the second chamber 232 to the first chamber 231. The filter 240 may help prevent contact of the beverage medium 210 with a needle or other liquid inlet that pierces the lid 270 to introduce water or other liquid into the cartridge 110. For example, some beverage media such as honey or powdered drink mixes may clog or otherwise foul an inlet needle if allowed to contact the needle. The filter 240 may help prevent such contact, helping to maintain proper operation of the cartridge and preparation of a beverage.

In this illustrative embodiment, the filter 240 may have a shape such as a fluted or conical shape with pleated sidewalls and a concave middle area 241. The filter 240 may be attached to the bottom of the container 290 in many suitable ways, such as by an adhesive, thermal welding, ultrasonic welding, chemical bonding, crimping, other mechanical bonding, a combination thereof, and/or the like. For example, the filter may be attached to the periphery of the bottom of the container by gluing or heat sealing. The filter 240 may include a permeable filter paper made of a combination of polypropylene and cellulose materials and may be attached to the bottom portion of the container 290 by thermal welding.

Figure 3:
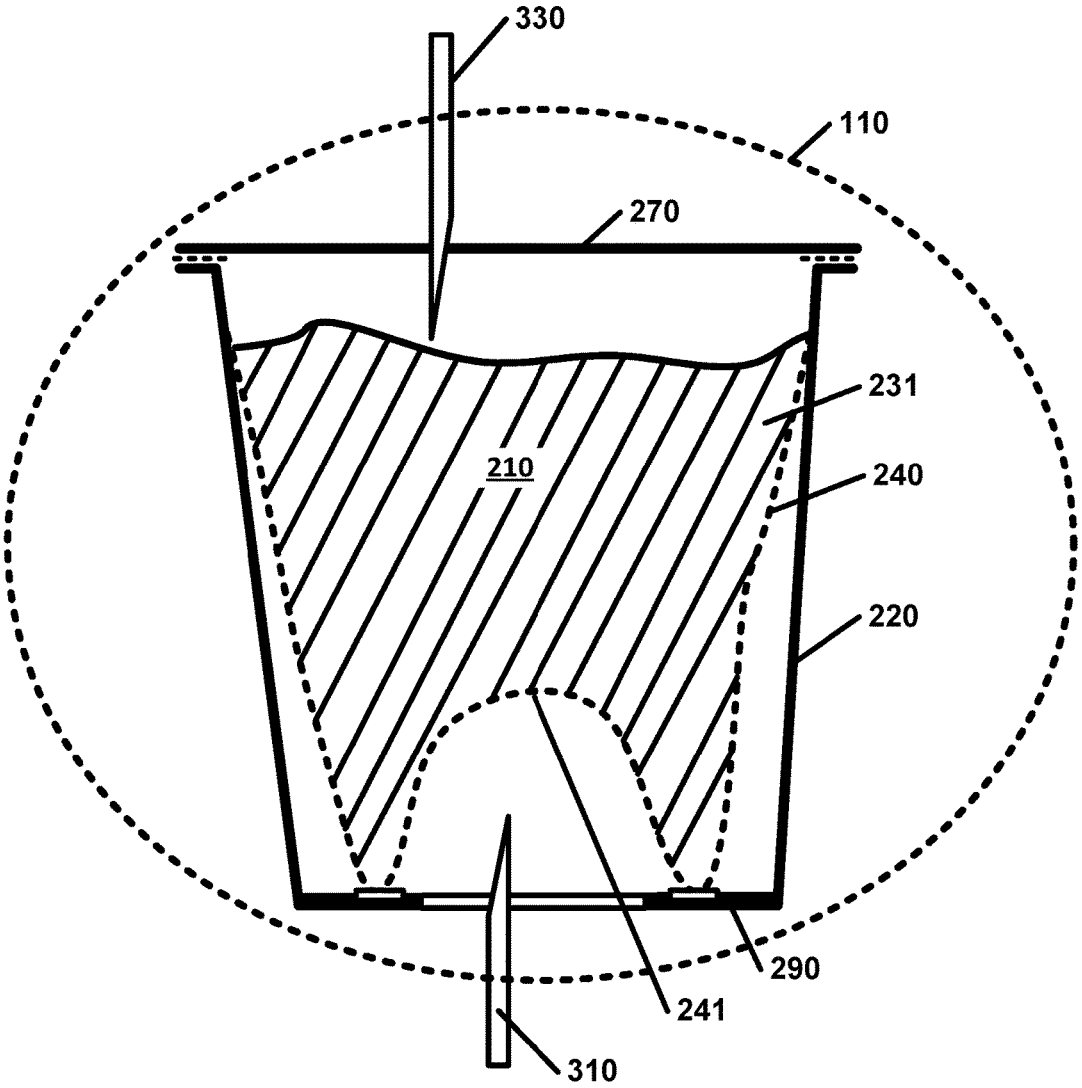
FIG. 3 is a diagram of a side cross-sectional view of the cartridge after the top and bottom surfaces of the cartridge are pierced by piercing instruments as per an aspect of an embodiment of the present invention.

FIG. 3 is a diagram of a side cross-sectional view of cartridge 110 after the top 270 and bottom 290 surfaces of container 220 are pierced by piercing instruments 310 and 330. When using cartridge 110 to prepare a beverage, cartridge 110 may also be penetrated by a first beverage machine piercing instrument 310 (e.g., a needle) at the bottom of the container 290. Alternatively, the first beverage machine piercing instrument 310 may include one or more hollow or solid needles, knives, blades, tubes, and so on. The first beverage machine piercing instrument 310 may create a flap or flange above the portion of the bottom of the container which it pierces. The cartridge 110 may include a valve, septum or other element that opens to permit beverage to exit or outflow when liquid is introduced into the cartridge, but may otherwise remain closed (e.g., to protect the beverage medium from external conditions such as oxygen, moisture or others). In such an embodiment, no piercing element for forming the outlet opening may be required, although one may be used, e.g., to allow the valve or other element to open. Also, in this illustrative embodiment, the first beverage machine piercing instrument 310 may remain in place to receive beverage as it exits the opening formed in the container 220 or lid 270. However, in some other embodiments, the first beverage machine piercing instrument 310 may withdraw after forming an opening, allowing beverage to exit the opening and be received without the first beverage piercing instrument 310 being extended into the cartridge 110.

Furthermore, when using the cartridge 110 to form a beverage, the lid 270 and/or the container 220 may be pierced to introduce liquid into the cartridge and receive beverage from the cartridge. As used herein, "beverage" may refer to a liquid substance that is formed when a liquid interacts with a beverage medium. For example, such a beverage may be intended for drinking. According to one of the various embodiments, a beverage refers to a liquid that is ready for consumption, e.g., is dispensed into a cup and ready for drinking, as well as a liquid that will undergo other processes or treatments, such as filtering or the addition of flavorings, creamers, sweeteners, another beverage, etc., before being consumed. According to some other embodiments, a beverage may include other liquids, including medicine, alcohol, sauces, and other solutions, etc. To introduce liquid into the cartridge, for example, as shown in FIG. 3, a portion of the lid 270 may be pierced by a second beverage machine piercing instrument 330 (e.g., a needle) so that water or other liquid may be injected into the cartridge 110. Other inlet piercing arrangements are possible, such as multiple needles, a shower head, a non-hollow needle, a cone, a pyramid, a knife, a blade, etc. A beverage machine that uses the cartridge may include multiple piercing elements of the same type or of different types, as the embodiments are not limited in this respect. In another arrangement, a beverage machine may include a piercing element (such as a spike) that forms an opening and thereafter a second inlet element (such as a tube) may pass through the formed hole to introduce liquid into (or conduct liquid out of) the container. In other embodiments, the lid 270 may be pierced, or otherwise effectively opened for flow, by introducing pressure at an exterior of the lid 270. For example, a water inlet may be pressed and sealed to the lid 270 exterior and water pressure introduced at the site. Water pressure may cause lid 270 to be pierced or otherwise opened to allow flow into cartridge 110. In another arrangement, lid 270 may include a valve, conduit or other structure that opens when exposed to a suitable pressure and/or when mated with a water inlet tube or other structure.

Although the embodiments described above include a beverage medium 210 only in the first chamber 231, those embodiments may include the beverage medium 210 in the second chamber 232 and/or other portions of cartridge 110. For example, cartridge 110 may include roast and ground coffee in the first chamber 231, and a creamer and sweetener in the second chamber 232, enabling the cartridge to form a cappuccino- or latte-like beverage. In another embodiment, the first chamber 231 may include coffee grounds and the second chamber 232 may include a hot chocolate material, allowing the cartridge to form a mocha-type beverage. Other combinations may occur to those of skill in the art, such as leaf tea in the first chamber and a dried fruit material in the second chamber, a dried fruit material in the first chamber and creamer/sweetener in the second chamber, and so on. In other embodiments, the filter 240 may be attached to the bottom of the container 290 on the periphery with the concave middle area 241 of the filter positioned above the first beverage machine piercing instrument 310.

Figure 4:
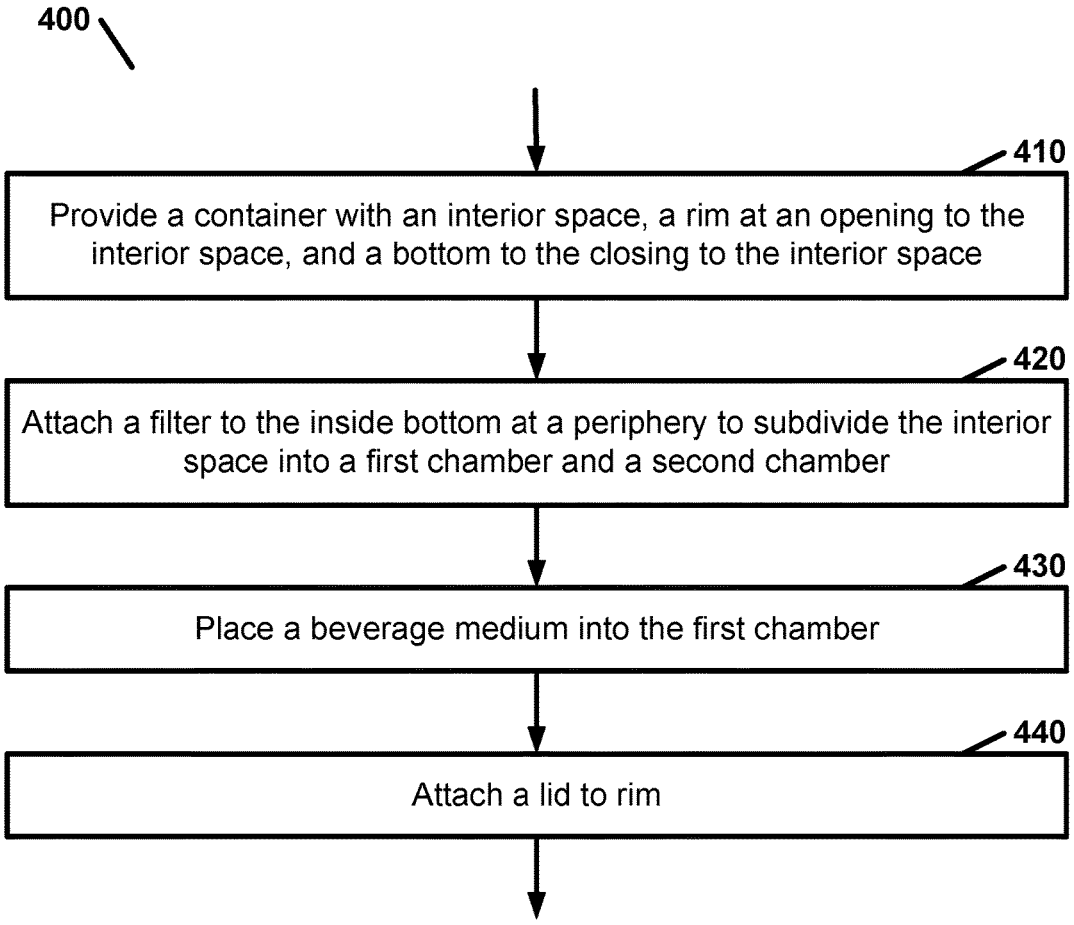
FIG. 4 is a flowchart of an example process for manufacturing a beverage cartridge as per an aspect of an embodiment of the present invention.

FIG. 4 is a flowchart of an example process 400 for manufacturing a beverage cartridge. In process 410, a container with an interior space, having a rim defining an opening into the interior space, and having a bottom to the closing to the interior space is provided. A rim may be just an opening or may be shaped. The container may be made of a suitable material, such as plastic, paper, metal and combinations of materials. Generally, the container may be impermeable to liquid so that a beverage created in the cartridge may be removed in a controlled fashion, but may have permeable portions. Also, the container may be configured with a shape such as frustoconical, spherical, cylindrical, a rectangular box, and so on. Moreover, the container need not have a defined shape, and instead may be made of a flexible material.

At 420, a filter may be attached to the inside bottom of the container at a periphery. The filter may have a concave middle area. The filter may be arranged to separate a first chamber from a second chamber in the interior space. Thus, the first chamber may be separated from the second chamber by the filter. The filter may include a suitable material such as filter paper, permeable or impermeable plastic material, a sponge like material, and so on. Also, the filter may include impermeable as well as permeable elements. The filter may have any suitable shape, size and/or permeability. For example, the filter may have areas of different permeability so as to prevent or restrict flow through some areas of the filter while facilitating flow through other, more permeable areas.

According to some embodiments a beverage medium may be provided in the first chamber of the interior space of the cartridge at 430. The beverage medium may be arranged to interact with liquid introduced into the container to form a beverage, and may include roast and ground coffee, leaf tea, instant coffee or tea, hot chocolate mix, a powdered drink mix, dried fruit materials, creamed honey, sweetener, creamer, thickener, and/or any other suitable material for forming a beverage.

Figure 7A:
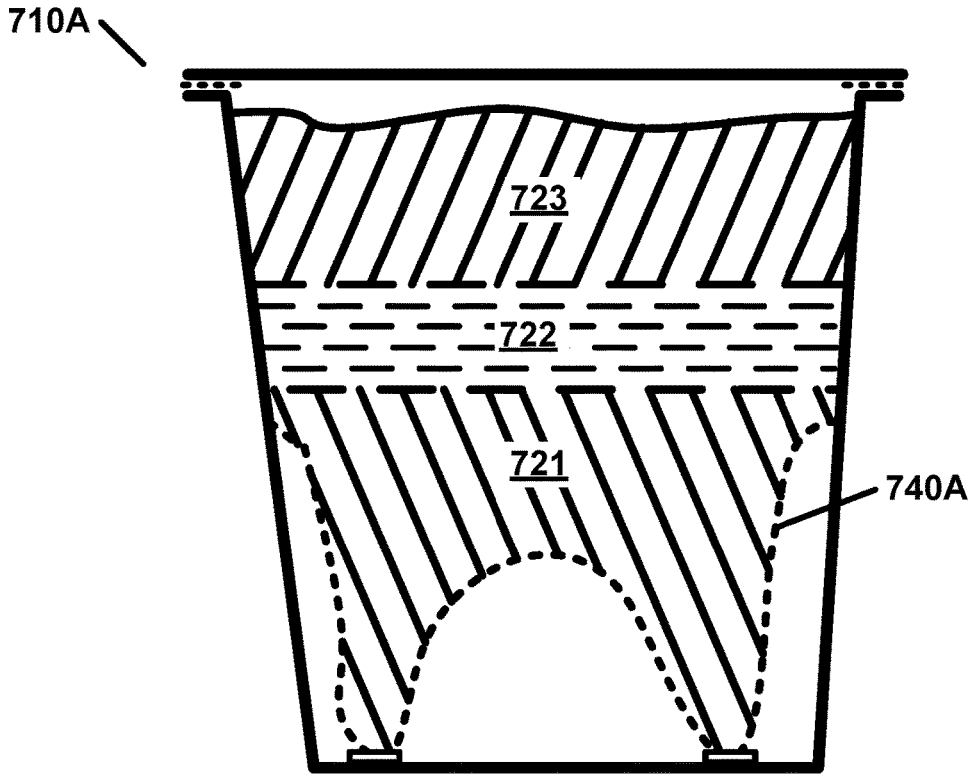
FIG. 7A and FIG. 7B are diagrams of a side cross-sectional view of alternative cartridges with creamed honey and tea as per an aspect of an embodiment of the present invention.

Example FIG. 7A is a diagram of a side cross-sectional view of a cartridge 710A with creamed honey 722 and tea 721 and 723 as per an aspect of an embodiment of the present invention. The beverage medium 721, 722, and 723 may consist of pre-creamed honey 722 and tea 721 and 723 to form tea sweetened with honey. Creamed honey is a honey that has been processed to control crystallization. Creamed honey may contain a large number of small crystals, which prevent the formation of larger crystals that can occur in unprocessed honey. The processing may also produce a honey with a smooth spreadable consistency. Other names for creamed honey include whipped honey, spun honey, churned honey, candied honey, honey fondant, and (in the UK) set honey. In other words, creamed honey may be formed when micro crystals form and spread in the honey due, in part, because of the large sugar content in honey. One process for initiating the process of creating creamed honey may include introducing seed crystal(s) into the honey. The honey may then be cooled, for example, through refrigeration. As the honey crystalizes, the viscosity of the honey may increase and the clarity of the honey may decrease. Pre-creamed honey may, for example, be made of 90-95% regular honey and 5-10% creamed honey. Employing a container that holds approximately 45 milliliters, a layer of tea leaves 721 (approximately 15 milliliters), followed by a layer of pre-creamed honey 722 (approximately 16 grams), and topped with a final layer of tea leaves 723 (approximately 5 milliliters) may be placed in the filter 740A. These approximate amounts may be adjusted for variations in container size, performance, taste, combinations thereof, and/or the like. After the beverage cartridge is sealed, the cartridge may sit upright for approximately 4 to 8 hours or even overnight. Next, the cartridge may be placed upside down in a refrigerator for a period of time such as 1 to 3 days (or longer), to prepare a beverage cartridge with pre-creamed honey and tea as its beverage medium.

Figure 7B:
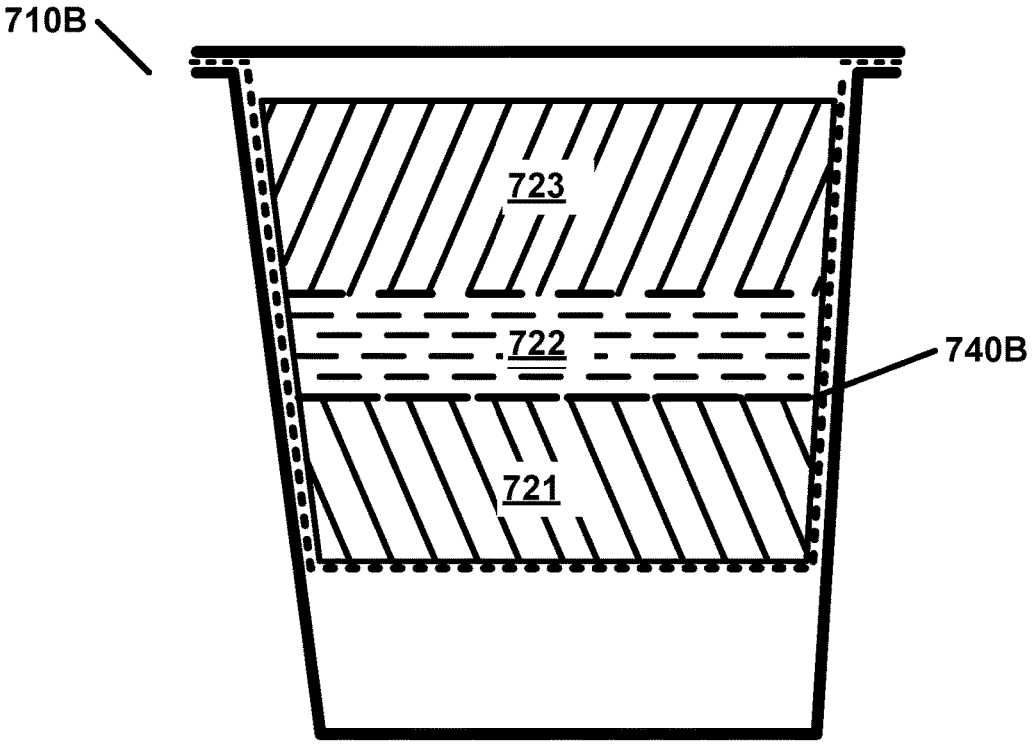

Example FIG. 7B is a diagram of a side cross-sectional view of a cartridge 710B with creamed honey 722 and tea 721 and 723 as per an aspect of an alternative embodiment of the present invention. FIG. 7B is similar to FIG. 7A with the notable difference that filter 740A is substituted with filter 740B. This FIG. 7B is illustrating how creamed honey may be employed in alternative cartridges.

In another embodiment, for a similarly sized container, a beverage medium may be made from blending approximately 20 milliliters of tea leaves with approximately 16 grams of pre-creamed honey, and then placing the blended m into the beverage cartridge. Furthermore in another embodiment, the beverage medium may consist of 1 layer of pre-creamed honey (approximately 16 grams) and 1 layer of tea leaves (approximately 20 milliliters) in the filter. For all the embodiments, if a greater or lesser quantity of tea leaves and pre-creamed honey are used, the shape of the pod may alter to accommodate this change. For example for some embodiments, the shape of the pod may be larger if more than 20 milliliters of tea leaves and 16 grams of pre-creamed honey are used.

According to the various embodiments, the substance (e.g. beverage medium) may be presweetened with creamed honey by many processes beyond what has been described above, including, but not limited to: mixing the substance with the creamed honey, blending the substance with the creamed honey, coating the substance with the creamed honey, chemically bonding the creamed honey to the substance. For example, when the substance is tea, the tea may be coated with a layer of creamed honey prior to being placed in the cartridge. Expand on the tea example, the tea may be mixed or blended with creamed honey prior to being placed in the cartridge. The blending and/or mixing may employ a mechanical device such as a blender. The substance and the honey may be pre-processed together prior to being placed in the cartridge. Preprocessing may include heating the substance (e.g. tea, coffee, etc) along with honey, and potentially a liquid. Crystals may then be introduced into the resultant mixture and cooled to let the sugar content of the honey crystalize.

At 440, the lid may be attached to the rim (e.g., to at least partially to close the opening). The lid may be attached to the rim in any number of suitable ways, such as thermal or acoustic welding, adhesive, chemical bonding, mechanical bonding, a combination thereof, and/or the like. In some embodiments, the rim may include a groove or other feature that assists in removal of the lid from the rim. Other embodiments may be configured to make it difficult to remove the lid from the rim. The lid may be made of any suitable material, such as a foil, a foil and polymer laminate, a polymer material, and so on, and may be permeable for some embodiments and impermeable for other embodiments. The lid may, for example, include a sheet of flexible material. However, the lid, according to some of the various embodiments, may be made of an impermeable material so as to aid in controlling the flow of liquid in the cartridge. The lid may have an annular shape.

It should be understood that actions outlined in FIG. 4 may be performed in any suitable order. For example, in one embodiment, the beverage medium may be provided in a space defined by the filter before the filter is attached to the bottom of the container. In another embodiment, the beverage medium may be provided into a space defined by the filter after the filter is attached to the bottom of the container. In yet another embodiment, the filter may be attached to the bottom of the container, and the beverage medium provided into a space defined by the filter either before or after the lid is attached to the container rim.

Figure 5:
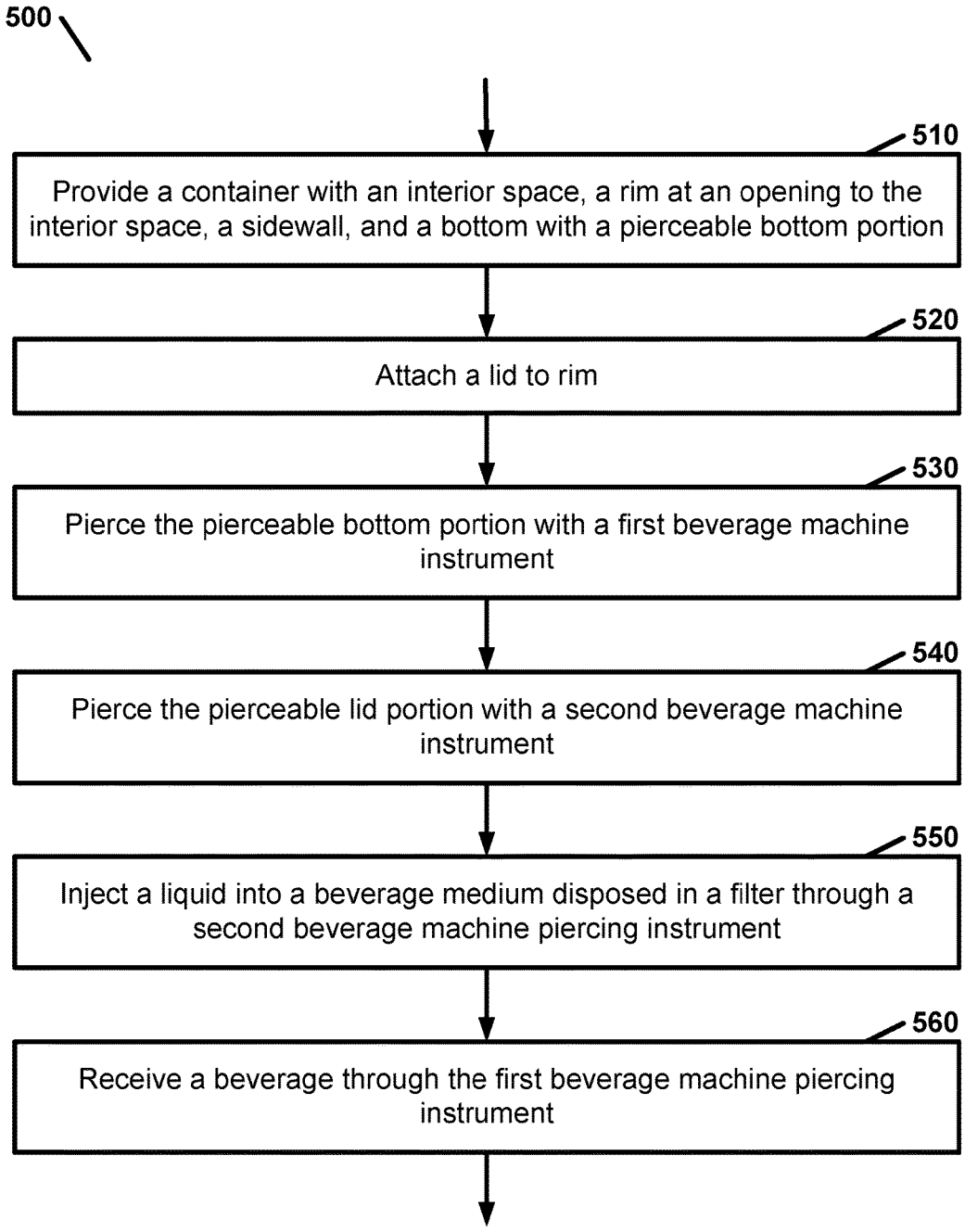
FIG. 5 is a flowchart of an example process of brewing a beverage using a beverage cartridge as per an aspect of an embodiment of the present invention.

Another aspect of some embodiments involves a process 500 for brewing a beverage using a beverage cartridge, e.g., as outlined in FIG. 5. At 510, a cartridge may be provided having a container with an interior space, a rim defining an opening to the interior space, a sidewall defining the side boundaries of the interior space, and a bottom with a pierceable bottom portion.

At 520, a lid may be attached to the rim and close the opening of the container. At 530, the pierceable bottom portion may be pierced by a first beverage machine piercing instrument to form a first opening. The piercing of the pierceable bottom portion of the container by the first beverage machine piercing instrument may be performed by inserting a needle, blade, knife or other suitable object through the lid, introducing water or other pressure to the lid to cause the lid to rupture or a valve or other structure to open for flow. At 540 a first portion of the lid may be pierced by the second beverage machine piercing instrument. The location of the piercing may, for example, be closer to the center of the lid than the rim. A second beverage machine piercing instrument may form a second opening. Piercing of the lid by the second beverage machine piercing instrument may be done by inserting a needle or other various ways as mentioned above.

At 550, liquid may be introduced into a filter with a beverage medium disposed in the filter via the second beverage machine piercing instrument. The filter may be comprised of an interior space bounded by a filter bottom, a filter sidewall, and a filter opening. The filter may have a concave middle and divide the container's interior space into first chamber and second chamber. The beverage medium may be arranged to interact with the liquid introduced into the container to form a beverage. As discussed above, the container, rim, lid and filter may be made of various materials and in various ways. Similarly, the beverage medium ray include suitable materials for forming a beverage when mixed with a liquid. The liquid may be heated and/or pressurized water. Other techniques may be employed to introduce liquid into the first chamber, such as inserting a tube through the first opening, mating an opening in a plate or other member to the lid near the first opening, and so on. At 560, a beverage may be received through the first beverage machine piercing instrument. The beverage may be formed by the interaction of the liquid with the beverage medium. The beverage may flow through the filter to the second chamber. Flow of the beverage through the filter may remove particulate matter from the beverage, such as larger coffee grounds, tea leaves and/or the like. The beverage may be removed from the cartridge via the first beverage machine piercing instrument.

The actions outlined in FIG. 5 may include additional actions, such as engaging the rim with a clamping mechanism prior to introducing liquid into the first chamber. For example, according to some of the various embodiments, the cartridge may be engaged by a brew chamber such that the rim of the cartridge is clamped in place so as to, for example, reduce the likelihood of the lid being separated from the rim during brewing and/or to reduce the likelihood of leakage. The lid and/or container may also be pierced by a third beverage machine piercing instrument to form a third opening to, for example, vent the interior space. This may be useful to help flood the interior space of the cartridge with liquid. The cartridge may be positioned so that the lid is in a downward facing orientation with the container above the lid and the lid in a plane that is transverse to a horizontal plane. According to some, but not necessarily all, of the embodiments, the plane in which the lid is oriented may be at an angle of about 20 degrees to 70 degrees to the horizontal plane, which may help the beverage formation as discussed above. Also, the actions outlined in FIG. 5 may be performed in orders different than h t shown in FIG. 5. For example, 530 and 540 may be performed simultaneously.

Figure 6:
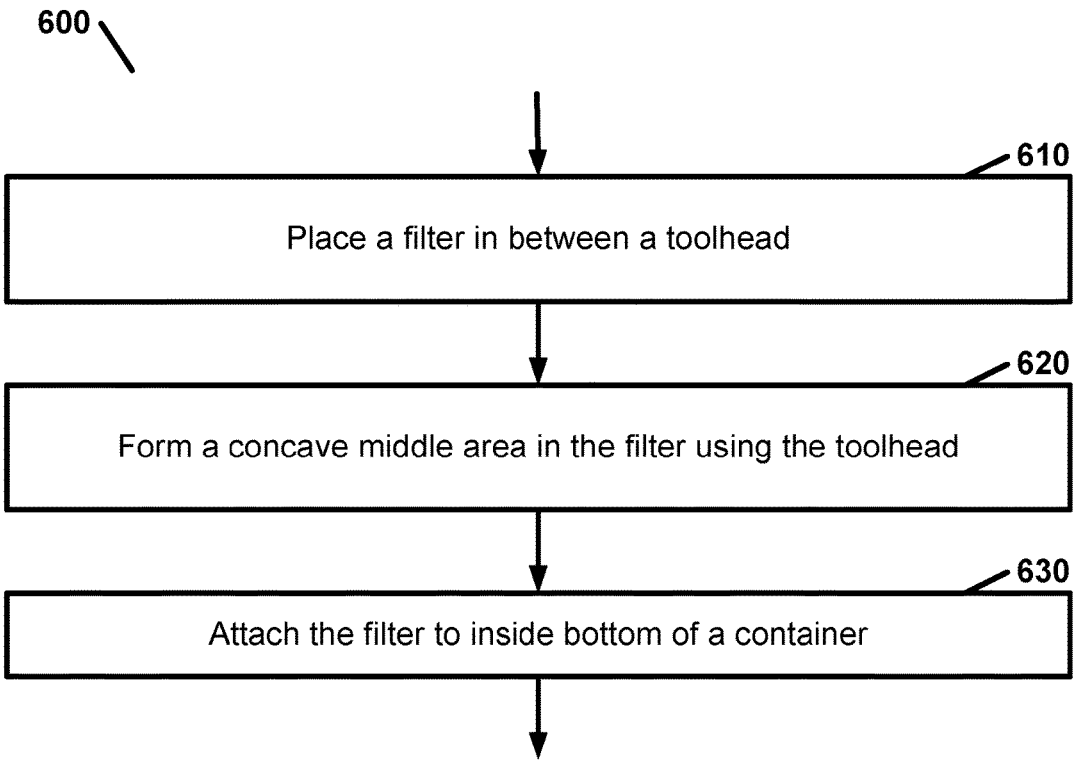
FIG. 6 is a flowchart of an example process of manufacturing a beverage filter using a toolhead as per an aspect of an embodiment of the present invention.

Another aspect of the embodiments involves a process 600 for manufacturing a beverage cartridge, e.g., as outlined in FIG. 6. At 610, a filter may be manually placed between a top part and bottom part of a toolhead which may have a top central concave area and a bottom matching convex central area where filter material may be received between. At 620, a concave middle area for the filter may be formed using the toolhead. There are many other ways of shaping the filter. For example, employing a toolhead with a vacuum clamp. In addition, according to some of the various embodiments, the filter may be pre-shaped. Finally at 630, the filter may be attached to a container of a beverage filter cartridge.

Figure 8:
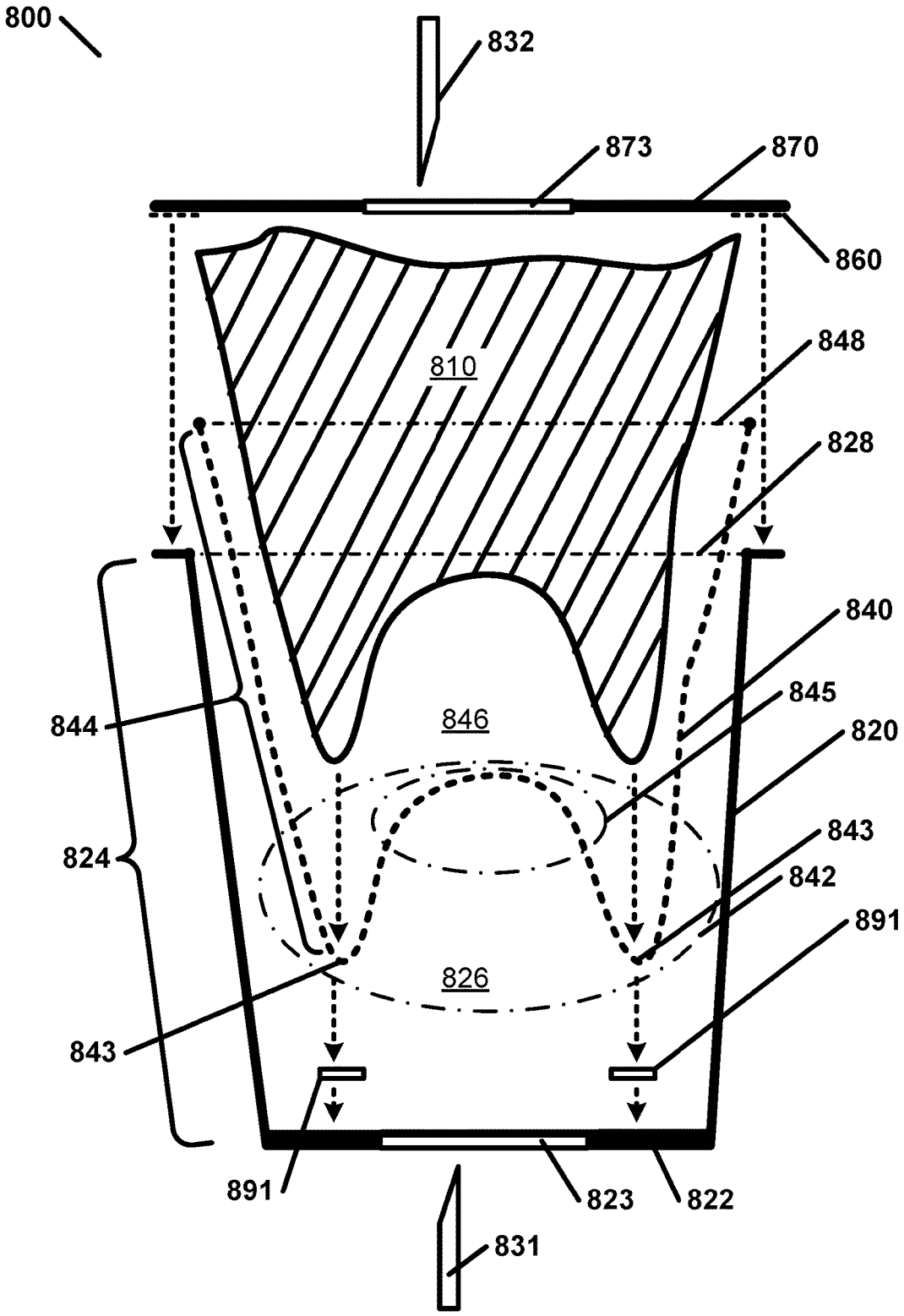
FIG. 8 is an exploded diagram of a side cross-sectional view of a cartridge as per an aspect of an embodiment of the present invention; and Example
Figure 9:
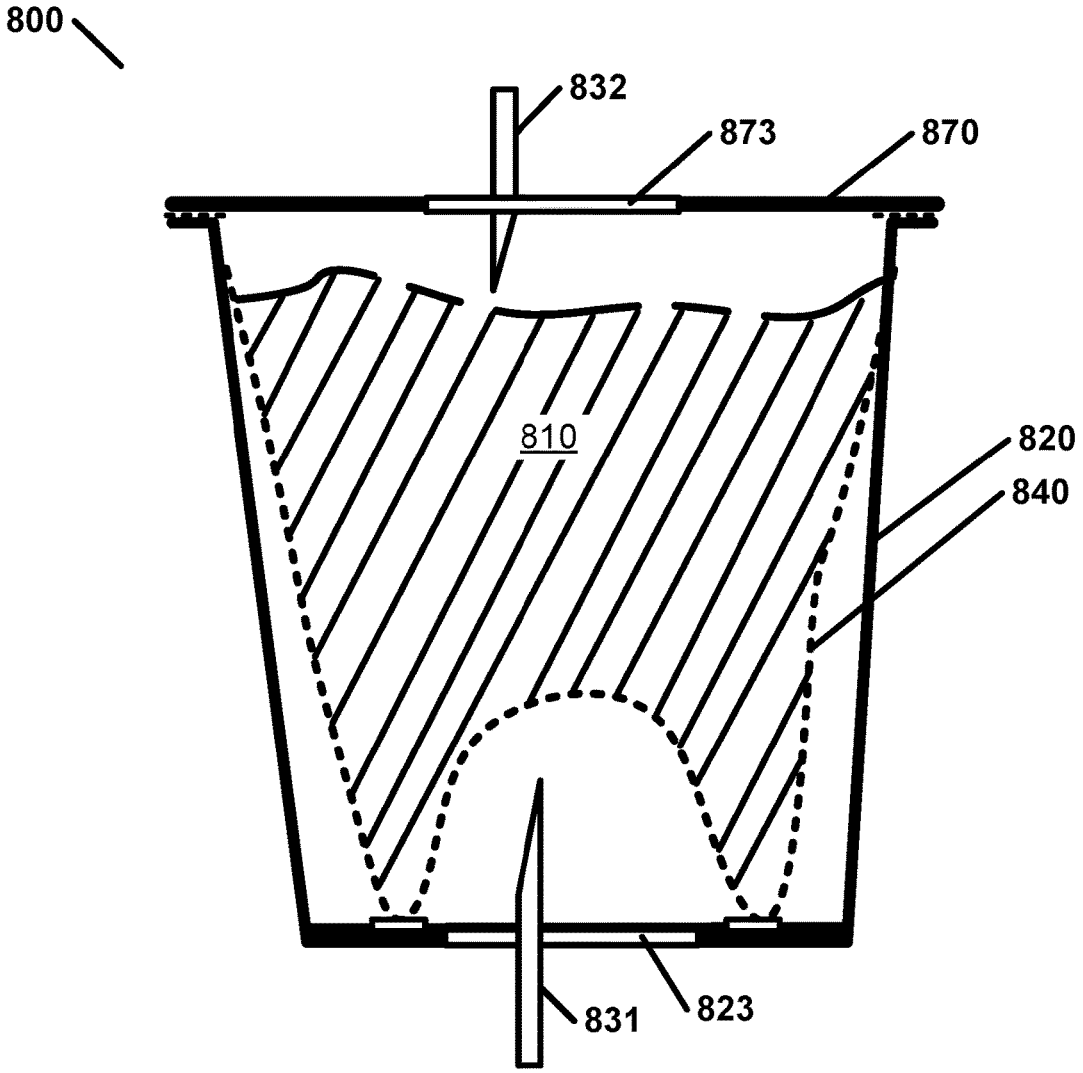
FIG. 9 is an un-exploded diagram of the example embodiment illustrated in FIG. 8.

Example FIG. 8 is an exploded diagram of a side cross-sectional view of a solution mixing cartridge 800 as per an aspect of an embodiment of the present invention. Example FIG. 9 is an un-exploded diagram of the example embodiment illustrated in FIG. 9, shown here for the sake of clarity.

The solution mixing cartridge 800 comprises at least a container 820, a filter 840, a lid 870, and a substance 810. Some of the various embodiments of cartridge 800 may be employed with a solution mixing machine. An example of a solution mixing machine is a beverage brewing machine configured to produce beverages such as tea, coffee, juice, and/or the like. Other examples of a solution mixing machine for which various embodiments of cartridge 800 may be employed include glue machines, cleaning machines, and/or the like.

Container 820 may include a container bottom 822, a container sidewall 824 and an interior space 826. The container bottom 822 may include a pierceable bottom portion 823 configured to be pierced by a first piercing element 831. First piercing element 831 may be part of the solution mixing machine. The container sidewall may extend upwardly from the container bottom 822 to a container opening 828. The container interior space 826 may be bounded by: the container bottom 822, the container sidewall 824, and the container opening 828.

The container 820 and/or the lid 870 may comprise, at least in part, an impermeable material. For example, lid 870 may be composed of, at least in part, a foil and polymer laminate material. The filter 840 may be shaped as needed to adapt to the container shape 820. For example, filter shapes may include, but are not limited to, fluted shapes, conical shapes, and/or the like. Similarly, container 820 shape may be adapted as needed to adapt for employment as a stand-alone cartridge and/or in use with a solution mixing apparatus. For example, container 820 shapes may include, but are not limited to, fluted shapes, conical shapes, and/or the like.

The filter 840 may be disposed inside container 820. Filter 840 may include at least a filter bottom 842, a filter sidewall 844, and a filter interior space 846. The filter bottom 826 may include a periphery 843, a concave center portion 845 disposed above the pierceable bottom portion 823. One or more attachment portions 891 may be located along the periphery where the filter 840 may be fastened to the container bottom 822 using any number of techniques and/or materials such as, but not limited to, glue, polymers, cordage, welding, heat processes, ultrasonic welding, combinations thereof, and/or the like. The filter sidewall 844 may extend upwardly from the filter bottom 826 towards a filter opening 828. The filter opening 828 may be disposed to contact the container sidewall 824. The contact may or may not be fastened. The filter interior space 846 may be bounded by the filter bottom 826, the filter sidewall 844 and the filter opening 848.

The lid 870 may be attached to the container opening 828. The attachment may be via an adhesive 860, a bond such as an ultrasonic weld, a heat weld, a mechanical cinch, combinations thereof, and/or the like. The lid 870 may also have a pierceable lid portion 873 configured to be pierced by a second machine piercing element 832. At least part of the lid 870 may include a sheet of flexible material.

A substance 810 may be disposed in the filter interior space 846. The substance 810 may be configured to interact with liquid to form a solution. According to some of the various embodiments, the substance may be configured to interact with a liquid to form a beverage. Examples of such beverages include tea, coffee, juice, mil, and/or the like. Examples of other substances that may be employed in a mixing cartridge 800 may include glue, cleaning solutions, and/or the like.

The substance 810, may include, at least part, a brewable ingredient. The substance 810, may include, at least part, an infusible ingredient. Additionally, the substance 810, may include, at least part, a sweetener such as, but not limited to, creamed honey, sugar, artificial sweeteners, stevia, aspartame, sucralose, neotame, acesulfame potassium, saccharin, combinations thereof, and/or the like.

The filter may be configured to: hold back a majority of the substance; and pass a majority of the solution. So for example, when the substance is tea, the filter may be configured to hold back tea leaves while allowing the liquid tea to pass. To accomplish this, the filter 840 may include, at least in part, a permeable filter paper.

An alternative filter 840 may be constructed of a rigid or semi-rigid material that is disposed at the bottom or near the bottom 822 of container 820. The rigid or semi-rigid material may include metals, plastics, composite materials, biodegradable materials, combinations thereof, and/or the like. According to some of the various embodiments, such a filter may also be held in place by friction along the sidewalls 824, the weight and/or volume of the substance 810, combinations thereof, and/or the like.

The construction of the filter material may need to be selected so that it is stiff enough, in combination with its placement in container 820, to support material 810. For example, the filter 840 may be made from about 100 g/m2 creped paper. The creping may allow the solution to flow through the filter 840. The raw materials (pulp) for the filter 840 may include coarse long fibers. Filter 840 may be bleached and/or unbleached. Parameters that may be employed in selecting a filter 840 may include strength, compatibility, efficiency and capacity.

Filter 840 may be made in different shapes and sizes to fit into different holders. The filter 840 may be shaped as needed to adapt to the container shape 820. For example, filter shapes may include, but are not limited to, fluted shapes, conical shapes, and/or the like. Similarly, container 820 shape may be adapted as needed to adapt for employment as a stand-alone cartridge and/or in use with a solution mixing apparatus. For example, container 820 shapes may include, but are not limited to, fluted shapes, conical shapes, and/or the like.

The container 820 and/or the lid 870 may comprise, at least in part, an impermeable material. For example, lid 870 may be composed of, at least in part, a foil and polymer laminate material.

The filter interior space 846 may be configured to receive a liquid through the second machine piercing element 832. The liquid may be a pressurized liquid. When this occurs, pressure may build in the solution mixing cartridge 800. To relieve this pressure, according to some of the various embodiments, the lid may further comprises a second pierceable lid portion (not shown) configured to be pierced by a third machine piercing element (not shown). The third machine piercing element may also be configured to introduce other liquids into cartridge 800. The first machine piercing element 831 may be configured to accommodate an outflow of solution from the cartridge 800.

A solution mixing device may be configured to accept and employ cartridge 800. When cartridge 800 is placed in the solution mixing device, the pierceable lid portion may be pierced with a lower force than the pierceable bottom portion.

According to an example embodiment, cartridge 800 may be used, for example, to make presweetened tea. A filter 840 may be placed in a container 820. The filter 840 may have a bottom portion 826 with a concave portion 845 and a periphery portion 843. The filter 840 may fastened inside container 820 to the container bottom 822 along at least one location 891 of the filter periphery portion 843 such that the concave portion 845 of the filter 840 is above a pierceable portion 823 of the container bottom 822 and the filter opening 848 touches the container sidewall 824. The filter 840 may be filled with a tea/creamed-honey mixture 810 (described earlier). A lid 870 with a lid pierceable portion 873 may be fastened along the edge of container opening 828. The cartridge 800 may be installed in a beverage machine. A first hollow pierceable element 831 may pierce the pieceable bottom portion 823 so that pierceable element 831 is inserted into container 820 below the concave portion 845 of filter 840. A second hollow pierceable element 832 may pierce the pieceable lid portion 873 so that pierceable element 832 is inserted into container 820 above (or near the top of) the tea/creamed-honey mixture 810. Hot and/or pressurized water may be injected into cartridge 800 through the second hollow pierceable element 832. The hot and/or pressurized water may then seep through the tea/creamed-honey mixture 810 to create a honey sweetened tea solution. The honey sweetened tea solution may exit the filter 840 and be collected by the beverage machine through the first hollow pierceable element 831.

The foregoing description provides illustration and description, but is not intended to be exhaustive or to limit the implementations to the precise form disclosed. Modifications and variations are possible in light of the above teachings or may be acquired from practice of the implementations. Such alterations, modifications, and improvements are intended to be part of this disclosure, and are intended to be within the spirit and scope of the invention. Accordingly, the foregoing description and drawings are by way of example only. For example, embodiments are disclosed towards consumable beverages. However, skilled in the art will recognize that the disclosed embodiments could be employed to, for example, be used to mix glue or to dispense medicine.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

No element, act, or instruction used in the present application should be constructed as critical or essential unless explicitly described as such. Also, as used herein, the articles "a" and "an" are intended to include one or more items.

It should be noted the terms "including" and "comprising" should be interpreted as meaning "including, but not limited to".

In this specification, "a" and "an" and similar phrases are to be interpreted as "at least one" and "one or more." References to "the," "said," and similar phrases should be interpreted as "the at least one", "said at least one", etc. References to "an" embodiment in this disclosure are not necessarily to the same embodiment.

It is the applicant's intent that only claims that include the express language "means for" or "step for" be interpreted under 35 U.S.C. 112. Claims that do not expressly include the phrase "means for" or "step for" are not to be interpreted under 35 U.S.C. 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

The invention claimed is:

1. A cartridge, comprising:

a container comprising a pierceable bottom portion structurally configured to be pierceable by a first machine piercing element;

a filter disposed inside the container, the filter comprising:

a pre-shaped concave center portion disposed above the pierceable bottom portion;

one or more attachment portions:

along a periphery of the pre-shaped concave center portion; and fastened to the container bottom; and a filter opening contacting a sidewall of the container;

a lid:

attached to an opening of the container; and comprising a pierceable lid portion structurally configured to be pierceable by a second machine piercing element; and a substance disposed in an interior space of the filter.

2. The cartridge of claim 1, wherein the lid comprises a sheet of flexible material.

3. The cartridge of claim 1, wherein the lid further comprises a second pierceable lid portion configured to be pierced by a third machine piercing element.

4. The cartridge of claim 1, wherein the filter interior space is configured to receive a pressurized liquid through the second machine piercing element.

5. The cartridge of claim 1, wherein the interior space is configured to receive a liquid through the second machine piercing element.

6. The cartridge of claim 5, wherein the substance is configured to interact with the liquid to form a solution.

7. The cartridge of claim 6, wherein the filter is configured to:

hold back a majority of the substance; and pass a majority of the solution.

8. The cartridge of claim 6, wherein the cartridge is configured to pass an outflow of the solution through the first machine piercing element.

9. The cartridge of claim 5, wherein the substance is configured to interact with the liquid to form a beverage.

10. The cartridge of claim 1, wherein at least a part of the container comprises an impermeable material.

11. The cartridge of claim 1, wherein at least part of the lid comprises an impermeable material.

12. The cartridge of claim 1, wherein at least part of the lid comprises a foil and polymer laminate material.

13. The cartridge of claim 1, wherein at least a part of the filter has a fluted or conical shape.

14. The cartridge of claim 1, wherein at a part of the container has a fluted or conical shape.

15. The cartridge of claim 1, wherein the filter comprises a permeable filter paper.

16. The cartridge of claim 1, wherein at least part of the substance comprises creamed honey.

17. The cartridge of claim 1, wherein at least part of the substance comprises a brewable ingredient.

18. The cartridge of claim 1, wherein at least one of the one or more attachment portions fasten to the container bottom using glue.

19. The cartridge of claim 1, wherein at least one of the one or more attachment portions are fastened to the container bottom using a heat process.

20. The cartridge of claim 1, wherein the pierceable lid portion is configured to be pierced with a lower force than the pierceable bottom portion.

* * * * *